US008333223B2

(12) United States Patent
Seo

(10) Patent No.: US 8,333,223 B2
(45) Date of Patent: Dec. 18, 2012

(54) ICE GUIDING APPARATUS OF DISPENSER FOR REFRIGERATOR

(75) Inventor: Sang-Wook Seo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 849 days.

(21) Appl. No.: 12/520,554

(22) PCT Filed: Jan. 9, 2008

(86) PCT No.: PCT/KR2008/000120

§ 371 (c)(1),
(2), (4) Date: Jun. 22, 2009

(87) PCT Pub. No.: WO2008/084973

PCT Pub. Date: Jul. 17, 2008

(65) Prior Publication Data

US 2010/0089493 A1 Apr. 15, 2010

(30) Foreign Application Priority Data

Jan. 9, 2007 (KR) ..... 10-2007-0002576

(51) Int. Cl.
*B67D 3/00* (2006.01)

(52) U.S. Cl. ..... 141/82; 141/104; 141/291; 141/360; 222/146.6; 62/3.63; 62/389

(58) Field of Classification Search ..... 141/82, 141/104, 291, 351, 360; 222/146.6; 62/3.63, 62/3.64, 382, 389
See application file for complete search history.

(56) References Cited

U.S. PATENT DOCUMENTS

| | | | | |
|---|---|---|---|---|
| 4,285,212 | A * | 8/1981 | Prada | 141/358 |
| 4,555,049 | A * | 11/1985 | Mawby et al. | 222/146.6 |
| 5,148,842 | A * | 9/1992 | Boust | 141/333 |
| 5,860,564 | A * | 1/1999 | Jablonski | 141/362 |
| 6,158,564 | A * | 12/2000 | Derelanko | 193/2 R |
| 6,648,187 | B1 * | 11/2003 | Shypkowski | 222/527 |
| 6,964,351 | B2 * | 11/2005 | Jablonski et al. | 141/82 |
| 7,007,500 | B2 * | 3/2006 | Lee | 222/146.6 |
| 7,980,089 | B2 * | 7/2011 | Bowen et al. | 62/344 |
| 8,196,618 | B2 * | 6/2012 | Kim et al. | 141/82 |

FOREIGN PATENT DOCUMENTS

| | | | |
|---|---|---|---|
| KR | 20-0152159 | Y1 | 7/1999 |
| KR | 10-0288921 | B1 | 5/2001 |
| KR | 10-0602593 | B1 | 7/2006 |

OTHER PUBLICATIONS

International Search Report dated Apr. 24, 2008 for Application No. PCT/KR2008/000120, 2 pages.

* cited by examiner

*Primary Examiner* — Gregory Huson
*Assistant Examiner* — Nicolas A Arnett
(74) *Attorney, Agent, or Firm* — Fish & Richardson P.C.

(57) ABSTRACT

An ice guiding apparatus of a dispenser for a refrigerator is disclosed. The ice guiding apparatus of the dispenser for the refrigerator, in the dispenser provided in the refrigerator and outwardly provides ice pieces, comprises: a fixing guider formed at the dispenser; and a moving guider for guiding the ice pieces to be outwardly provided by moving along fixing guider. According to the ice guiding apparatus of the dispenser for the refrigerator, it is capable of preventing interference between an ice discharge opening and an ice container putted at the dispenser and precisely guiding the ice pieces into the ice container.

25 Claims, 8 Drawing Sheets

ICE GUIDING APPARATUS OF DISPENSER FOR REFRIGERATOR

TECHNICAL FIELD

The present invention relates to a refrigerator, and more particularly, to an ice guiding apparatus of a dispenser for a refrigerator.

BACKGROUND ART

Generally, a refrigerator is an appliance which has a cooling chamber for storing food at a low temperature. The cooling chamber can be divided into a freezing chamber maintained at a temperature below a freezing point and a refrigerating chamber maintained at the temperature above the freezing point depending on the temperature maintained in the cooling chamber of the refrigerator.

The refrigerator may be provided with an ice maker for making ice and a dispenser for supplying the ice made by the ice maker to a user. An ice duct is disposed between the ice maker and the dispenser. The ice duct is a passage for transferring the ice made by the ice maker to the dispenser.

If the user puts a cup at the dispenser and operates an operation lever, the ice made by the ice maker may pass through the ice duct and thus be supplied into the user's cup through an ice discharge opening formed at an end portion of the ice duct.

However, in the related art, in order to prevent interference between the ice discharge opening and the cup putted at the dispenser, the dispenser is fabricated to have a lower end of the ice discharge opening and an upper end of the cup spaced from each other by a certain distance.

Due to the distance spaced between the lower end of the ice discharge opening and the upper end of the cup putted at the dispenser, the ice discharged through the ice discharge opening may not be discharged into the cup but discharged out of the cup.

DISCLOSURE OF THE INVENTION

Technical Problem

Therefore, it is an object of the present invention to provide an ice guiding apparatus of a dispenser for a refrigerator having a structure which is capable of precisely guiding ice into an ice container with preventing interference between an ice discharge opening and the ice container putted at the dispenser.

Technical Solution

To achieve these objects, in accordance with one aspect of the present invention, there is provided an ice guiding apparatus of a dispenser for a refrigerator, in the dispenser provided in the refrigerator, for outwardly providing ice pieces, the ice guiding apparatus comprising: a fixing guider formed at the dispenser; and a moving guider for guiding the ice pieces to be outwardly provided by moving along the fixing guider.

In accordance with another aspect of the present invention, there is provided an ice guiding apparatus of a dispenser for a refrigerator, in the dispenser provided in the refrigerator, for outwardly providing ice pieces made by an ice maker and supplied through an ice duct, the ice guiding apparatus comprising: a fixing guider connected to the ice duct; and a moving guider for guiding the ice pieces to be outwardly provided after passing through the ice duct.

In accordance with still another aspect of the present invention, there is provided an ice guiding apparatus of a dispenser for a refrigerator, in the dispenser provided in the refrigerator, for outwardly providing ice pieces made by an ice maker and supplied through an ice duct, the ice guiding apparatus comprising: a fixing guider connected to the ice duct; a moving guider for guiding the ice pieces to be outwardly provided after passing through the ice duct, by moving along the fixing guider; and a guide portion for guiding the ice pieces supplied through the ice duct into an inlet of the moving guider.

In accordance with yet still another aspect of the present invention, there is provided an ice guiding apparatus of a dispenser for a refrigerator, in the dispenser provided in the refrigerator, for outwardly providing ice pieces made by an ice maker and supplied through an ice duct, the ice guiding apparatus comprising: a fixing guider connected to the ice duct; a moving guider for guiding the ice pieces to be outwardly provided after passing through the ice duct, by moving along the fixing guider; and a driving unit for providing a driving force for moving the moving guider along the fixing guider.

In accordance with yet still another aspect of the present invention, there is provided an ice guiding apparatus of a dispenser for a refrigerator, in the dispenser provided in the refrigerator, for outwardly providing ice pieces, the ice guiding apparatus comprising: a fixing guider formed at the dispenser; a moving guider for guiding the ice pieces to be outwardly provided after moving along the fixing guider; a sensor sensing whether or not a cup is putted at the dispenser; a control unit transferring a command for controlling movement of the moving guider according to a value sensed by the sensor; and a driving unit for moving the moving guider according to the command from the control unit.

MODES FOR CARRYING OUT THE PREFERRED EMBODIMENTS

Hereinafter, an ice guiding apparatus of a dispenser for a refrigerator in accordance with a first embodiment of the present invention will be explained with reference to the accompanying drawing.

Figure 1:
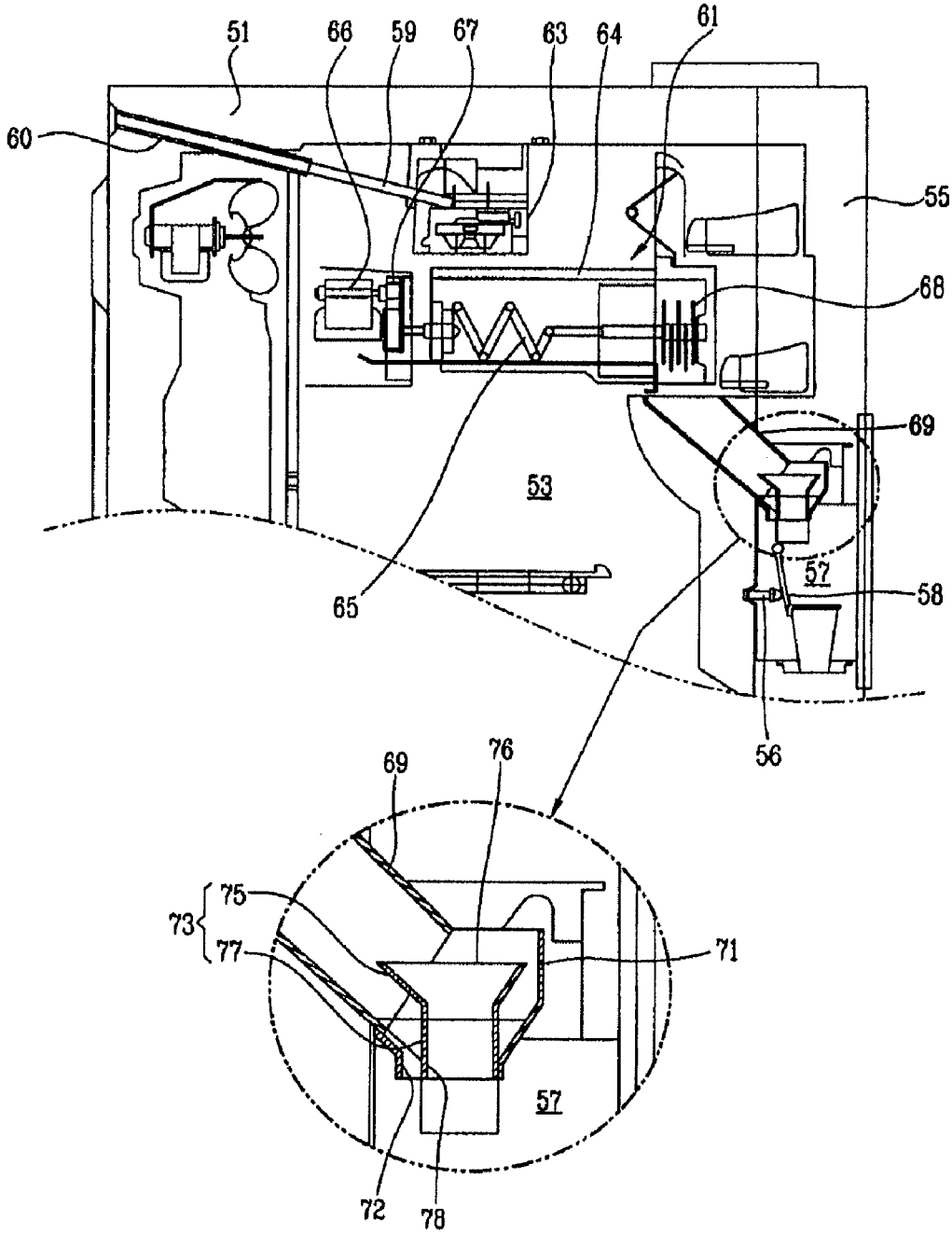
FIG. 1 is a schematic section view partially showing a refrigerator having an ice guiding apparatus of a dispenser in accordance with a first embodiment of the present invention.

FIG. 1 is a schematic section view partially showing the refrigerator having the ice guiding apparatus of the dispenser in accordance with the first embodiment of the present invention.

Referring to FIG. 1, a freezing chamber 53 is provided in a refrigerator main body 51. Food items are stored in the freezing chamber 53. The freezing chamber 53 is selectively opened or closed by a door 55. The door 55 is installed at one side of the main body 51 to have another end portion which is rotatable in front and rear directions of the main body 51 centering around one end portion thereof.

Meanwhile, a dispenser 57 is provided at one surface of a front side of the door 55. The dispenser 57 serves to outwardly discharge water or ice without opening the door 55. The dispenser 57 is formed by an inwardly concaved portion of the front surface of the door 55.

A switch 56 is provided at the dispenser 57. The switch 56 operates to input a manipulation signal for outwardly discharging water or ice through the dispenser 57. Also, a manipulation lever 58 for manipulating the switch 56 is provided at the dispenser 57.

And, a water supply pipe 59 is led in an upper portion of the refrigerating chamber 53. The water supply pipe 59 serves to supply water for making ice in an ice maker 61 which is to be explained hereafter. A heater 60 is provided at an outer circumferential surface of the water supply pipe 59. The heater 60 emits heat by a certain temperature so as to prevent the water supply pipe 59 from being frozen.

Also, the ice maker 61 is installed at the upper portion of the freezing chamber 53. The ice maker 61 operates to make ice, cut the ice into a certain sized pieces and transfer the ice pieces to the dispenser 57.

An ice making unit 63 is provided in the ice maker 61. The ice making unit 63 operates to substantially make ice by using water supplied through the water supply pipe 59. And, an ice bank 64 is installed at a lower side of the ice making unit 63. The ice bank 64 stores the ice made by the ice making unit 63 therein.

And, an ice-transferring screw 65 formed in a spiral shape is provided in the ice bank 64. The ice-transferring screw 65 operates to transfer the ice stored in the ice bank 64 toward a front side of the ice bank 61, that is an ice-breaking cutter 68 to be explained hereafter.

A transfer motor 66 is installed at a rear side of the ice bank 64. The transfer motor 66 provides a driving force for rotation of the ice-transferring screw 65 and the ice-breaking cutter 68. Also, a gear box 67 is provided between the rear side and the transfer motor 66. A plurality of gears are provided in the gear box 67, for increasing a driving torque by reducing the driving force of the transfer motor 66.

In addition, the ice-breaking cutter 68 is provided at the front side of the ice bank 64. The ice-breaking cutter 68 operates to break the ice transferred by the ice-transferring screw 65 into ice pieces having a certain size.

An ice duct 69 is provided to guide the ice pieces having broken by the ice-breaking cutter 68 to the dispenser 57. The ice duct 69 has a pipe shape having a certain sectional area of flow and penetrates the door 55. The ice duct 69 is extended to be downwardly inclined in a certain angle from the ice maker 61 toward the dispenser 57.

Here, the ice duct 69 has both end portions that are respectively disposed to be adjacent to the ice maker 61, substantially, to right blow the ice-breaking cutter 68, and is installed to penetrate the door 55 so as to be communicated with the dispenser 57.

And, a fixing guider 71 is provided at one end portion of the ice duct 69 which penetrates the door 55 and then is communicated with the dispenser 57. The fixing guider 71 is approximately formed in a hopper shape and substantially communicated with one end portion of the ice duct 69. A fixing guide opening 72 is provided at a lower end of the fixing guider 71.

A moving guider 73 is provided in the fixing guider 71. The moving guider 73 is installed to be movable upwardly and downwardly so that the moving guider 73 can be selectively protruded to an outside of the fixing guider 71 through the fixing guide opening 72. Thus, substantially, the moving guider 73 operates to reduce a distance between the moving guider 73 and an ice container for putting the ice pieces therein, for example, a cup.

Preferably, in a state that the moving guider 73 is protruded to the outside of the fixing guider 71 through the fixing guide opening 72, a gap is not formed between the fixing guider 71 and the moving guider 73. Thereby being capable of preventing the ice pieces guided by the ice duct 69 from being caught in the gap between the fixing guider 71 and the moving guider 73 or being discharged through the gap. And, the moving guider 73 includes a stopping portion 75 and a guiding portion 77.

The stopping portion 75 operates to prevent the moving guider 73 from being entirely slipped down from the fixing guider 71 when moving the fixing guider 73 downwardly with respect to the fixing guider 71. For this purpose, when the moving guider 73 moves downwardly with respect to the fixing guider 71, the stopping portion 75 is stopped at one side of the fixing guider 71.

Preferably, the stopping portion 75 is formed in the hopper shape having opened upper and lower ends in correspondence with the hopper shaped fixing guider 71. And, a moving guider inlet 76 is provided at the upper end of the stopping portion 75, for guiding the ice pieces guided by the ice duct 69 and the fixing guider 71 into the guiding portion 77.

Meanwhile, the guiding portion 77 has the upper end downwardly extended to be communicated with the lower end of the stopping portion 75. And, an ice discharge opening 78, an ice guider outlet through which the ice pieces guided by the ice duct 69 are discharged, is provided at the lower end of the guiding portion 77. The guiding portion 77 substantially serves to reduce the distance between the moving guider and the ice container by moving inwardly and outwardly the fixing guider 71 through the fixing guide opening 72.

In this embodiment, the fixing guider 71 is formed at the dispenser 57, and the moving guider 73 moves along the fixing guider 71, thereby guiding the ice pieces supplied through the ice duct 69.

More particularly, the fixing guider 71 is connected to the ice duct 69 for supplying the ice made by the ice maker 61 toward the fixing guider 71, and the moving guider 73 upwardly and downwardly moves along the fixing guider 71, thereby guiding the ice pieces that are outwardly provided through the ice duct 69.

The stopping portion 75 of the moving guider 73 is formed in the hopper shape, that is a shape having a sectional area decreased toward the lower side, thereby being stopped at the fixing guider 71 when moving downwardly. By this operation, a range for upwardly and downwardly moving the moving guider 73 may be restricted.

Here, the moving guider 73 may be moved downwardly by a load of the ice pieces supplied through the ice duct 69.

When the moving guider 73 stops moving downwardly due to the stopping portion 75, the ice pieces passed through the ice duct 69 are introduced through the moving guider inlet 76 provided at the upper end of the stopping portion 75. Because the stopping portion 75 is communicated with the guiding portion 77, the introduced ice pieces are discharged into the ice container through the ice discharge opening 78 after passing through the guiding portion 77.

Here, according to the aforementioned configurations of the stopping portion 75 and the guiding portion 77, a size of the inlet of the moving guider 73 is formed to be larger than that of the outlet thereof, accordingly the ice pieces can be smoothly moved therethrough.

When the moving guider 73 downwardly moves along the fixing guider 71, the end portion of the moving guider 73 is outwardly protruded from the fixing guider 71. Then, a passage for guiding the ice pieces is extended. Thus, the distance spaced between the upper end of the ice container putted at the dispenser 57 and the lower end of the moving guider 73 can be reduced, accordingly the ice pieces may be precisely discharged into the ice container.

Also, when requirement for supplying the ice is stopped, the moving guider 73 moves back into its original position, the fixing guider 71. Accordingly, when separating the ice container from the dispenser 57, it is capable of separating the ice container without interference by the moving guider 73.

Hereafter, an ice guiding apparatus of a dispenser for a refrigerator in accordance with other embodiments of the present invention will be explained with reference to the accompanying drawings. In the explanation, Detailed description about the configurations of embodiments which are the same as those of the first embodiment will be omitted.

Figure 2:
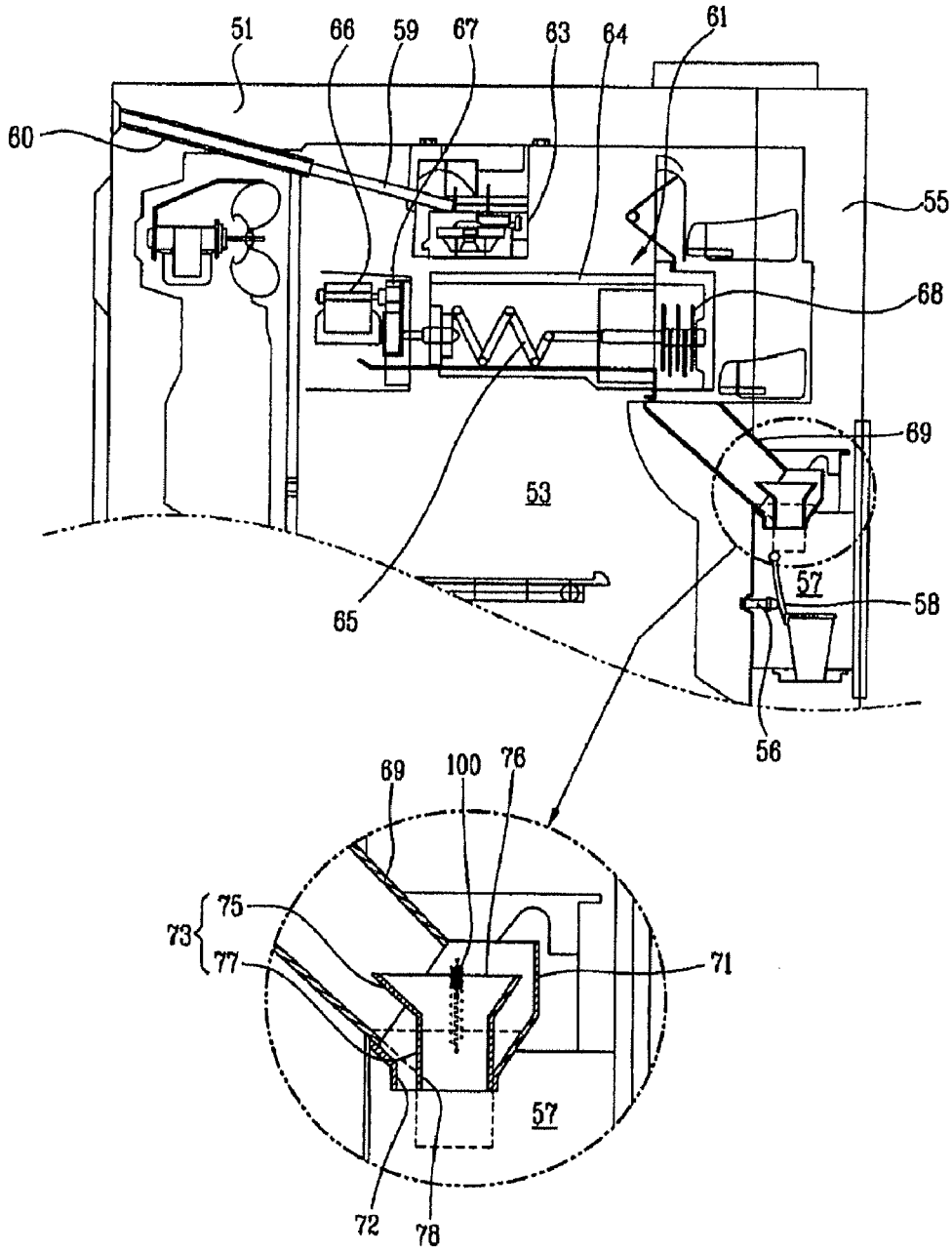
FIG. 2 is a schematic section view partially showing a refrigerator having an ice guiding apparatus of a dispenser in accordance with a second embodiment of the present invention.

FIG. 2 is a schematic section view partially showing the refrigerator having the ice guiding apparatus of the dispenser in accordance with the second embodiment of the present invention.

Referring to FIG. 2, in this embodiment, the fixing guider 71 is connected to the ice duct 69 and the moving guider 73 moves along the fixing guider 71 so as to guide the ice pieces outwardly supplied after passing through the ice duct 69.

Also, each end of an elastic member 100 is connected to the fixing guider 71 and the moving guider 73, thereby being capable of providing an elastic force for moving the moving guider 73 which has been moved back into its original position.

With providing the elastic member 100, the moving guider 73 may be moved by the load of the ice pieces supplied through the ice duct 69 and move back into its original position by the elastic force supplied from the elastic member 100. Accordingly, because it does not require to supply an additional external force for moving the moving guider 73 upwardly and downwardly, it is capable of enhancing convenience when using the ice guiding apparatus.

Figure 3:
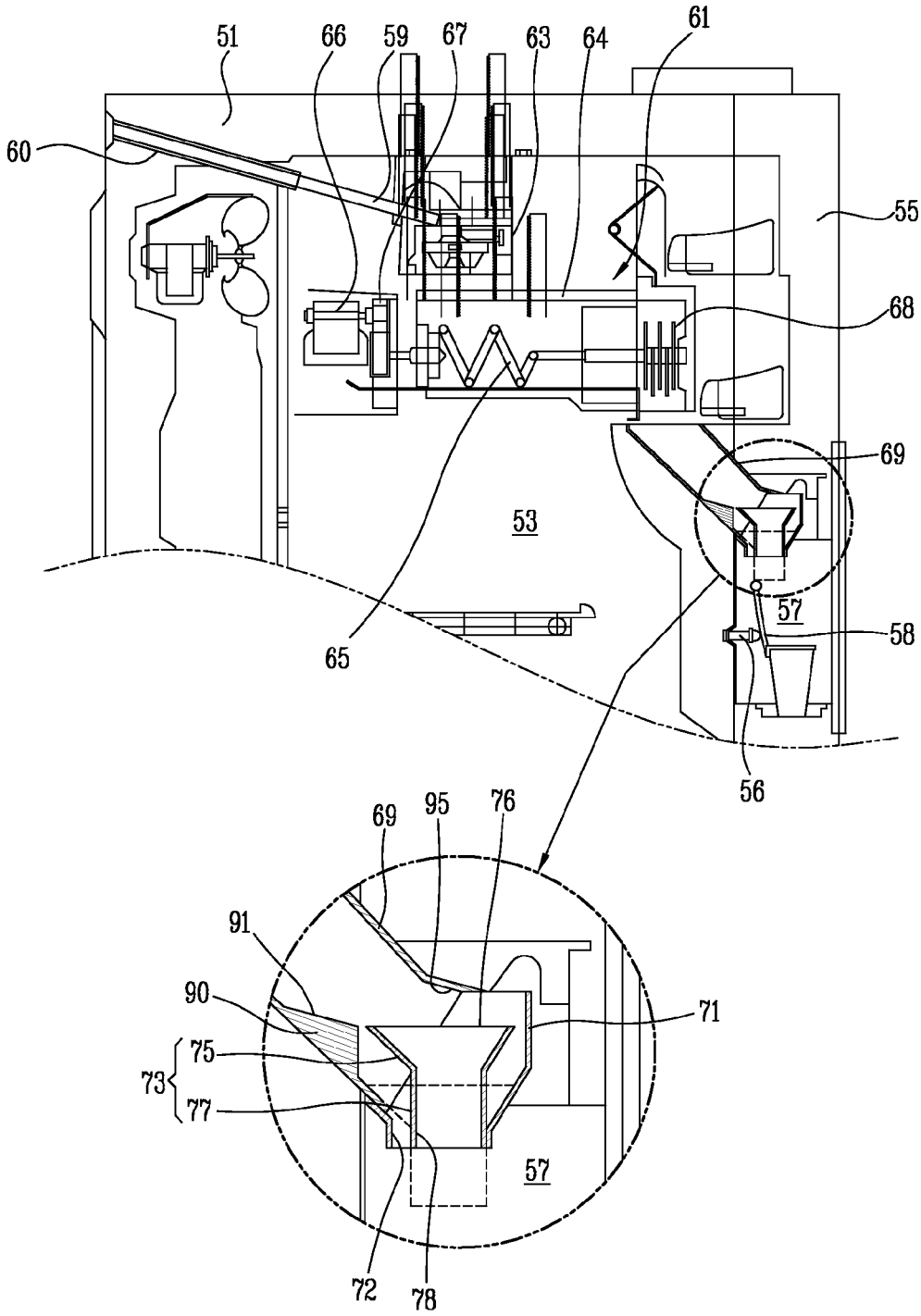
FIG. 3 is a schematic section view partially showing a refrigerator having an ice guiding apparatus of a dispenser in accordance with a third embodiment of the present invention.

FIG. 3 is a schematic section view partially showing a refrigerator having an ice guiding apparatus of a dispenser in accordance with the third embodiment of the present invention.

Referring to FIG. 3, in this embodiment, the fixing guider 71 is connected to the ice duct 69, and the moving guider 73 moves along the fixing guider 71 so as to guide the ice pieces outwardly supplied after passing through the ice duct 69.

Also, a guide portion 90 serves to guide the ice pieces supplied through the ice duct 69 to the moving guider inlet 76.

More particularly, an upper end surface of the guide portion 90 serves as an ice-guiding surface 91 which the ice pieces supplied through the ice duct 69 pass therethrough. The ice-guiding surface 91 and the moving guider inlet 76 are configured to be smoothly connected to each other.

According to the above configuration, the ice pieces supplied through the ice duct 69 can be smoothly introduced into the moving guider 73 by the guide portion 90, thereby being capable of smoothly moving the ice pieces in the ice guiding apparatus.

Meanwhile, an expansion portion 95 is formed at a portion facing the guide portion 90 of the ice duct 69. The expansion portion 95 is spaced from the guide portion 90 by maintaining a specific distance, thereby being capable of expanding the passage for passing the ice pieces supplied through the ice duct 69. Thus, it is capable of smoothly moving the ice pieces in the ice guiding apparatus.

Meanwhile, as another embodiment of the guide portion 90, the guide portion 90 may be formed of a flexible material so that the guide portion may have one side connected to the ice duct 69 and the other side connected to a peripheral portion of the moving guider inlet 76. The guide portion 90 may be implemented as a net shape.

According to the flexible guide portion 90, the ice pieces moved along the ice duct 69 may be guided into the moving guider inlet 76 along the guide portion 90. Also, even if the moving guider 73 has moved, but the guide portion 90 is still connected to the moving guider inlet 76. Accordingly, the ice pieces moved along the ice duct 69 can be still guided into the moving guider inlet 76 along the guide portion 90.

Figure 4:
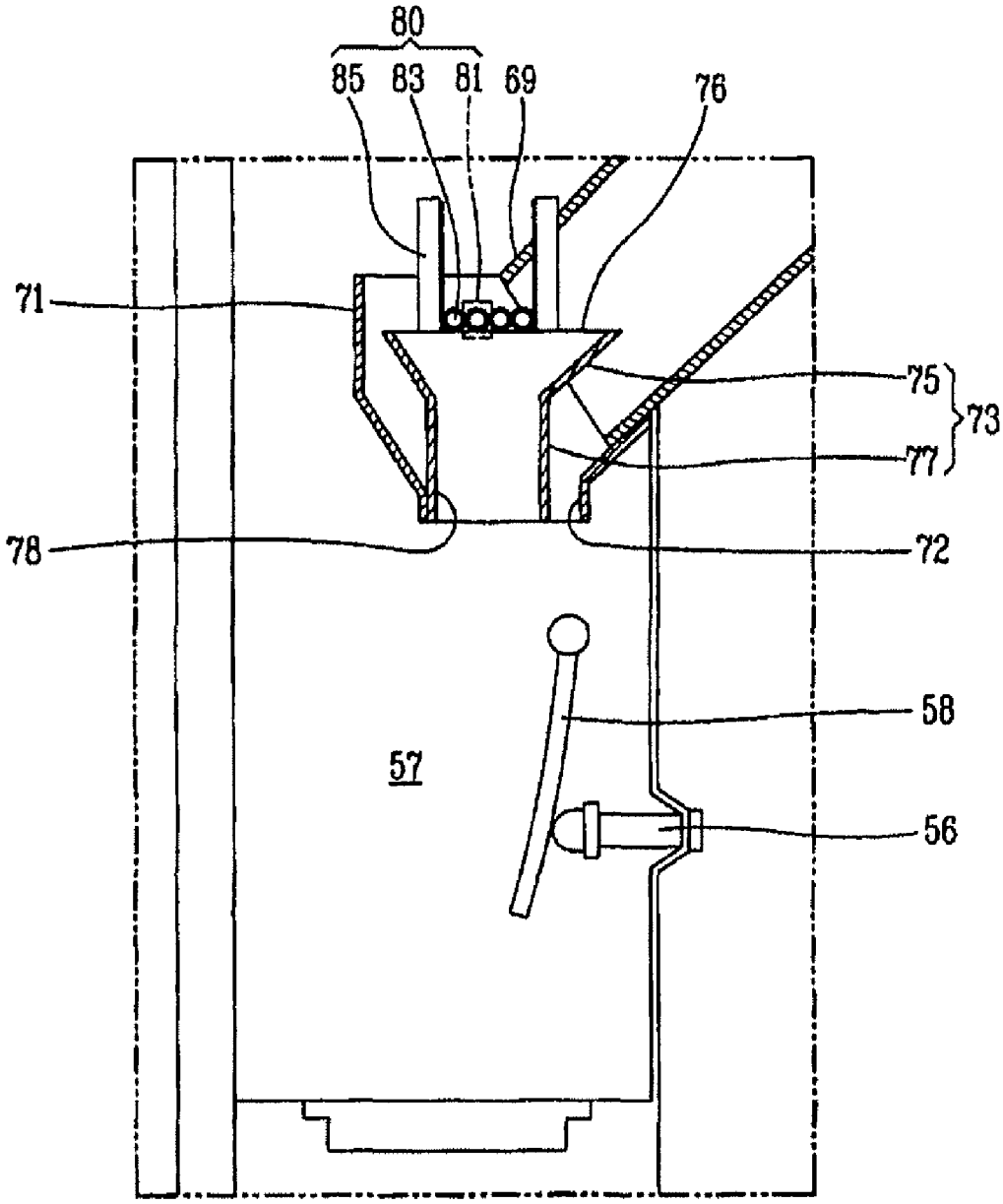
FIG. 4 is a schematic section view showing that a moving guider is located in a fixing guider in a refrigerator having an ice guiding apparatus of a dispenser in accordance with a fourth embodiment of the present invention.
Figure 5:
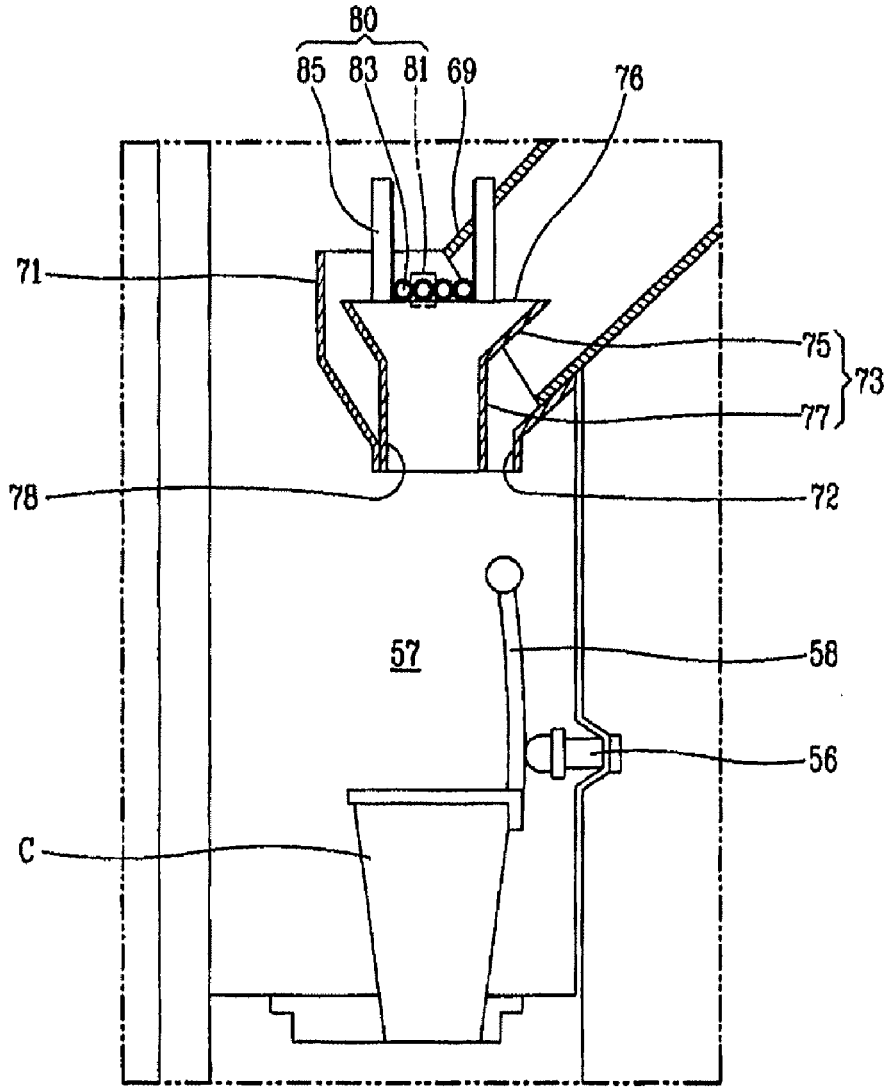
FIG. 5 is a section view showing that an operation lever shown in FIG. 4 is pressed.
Figure 6:
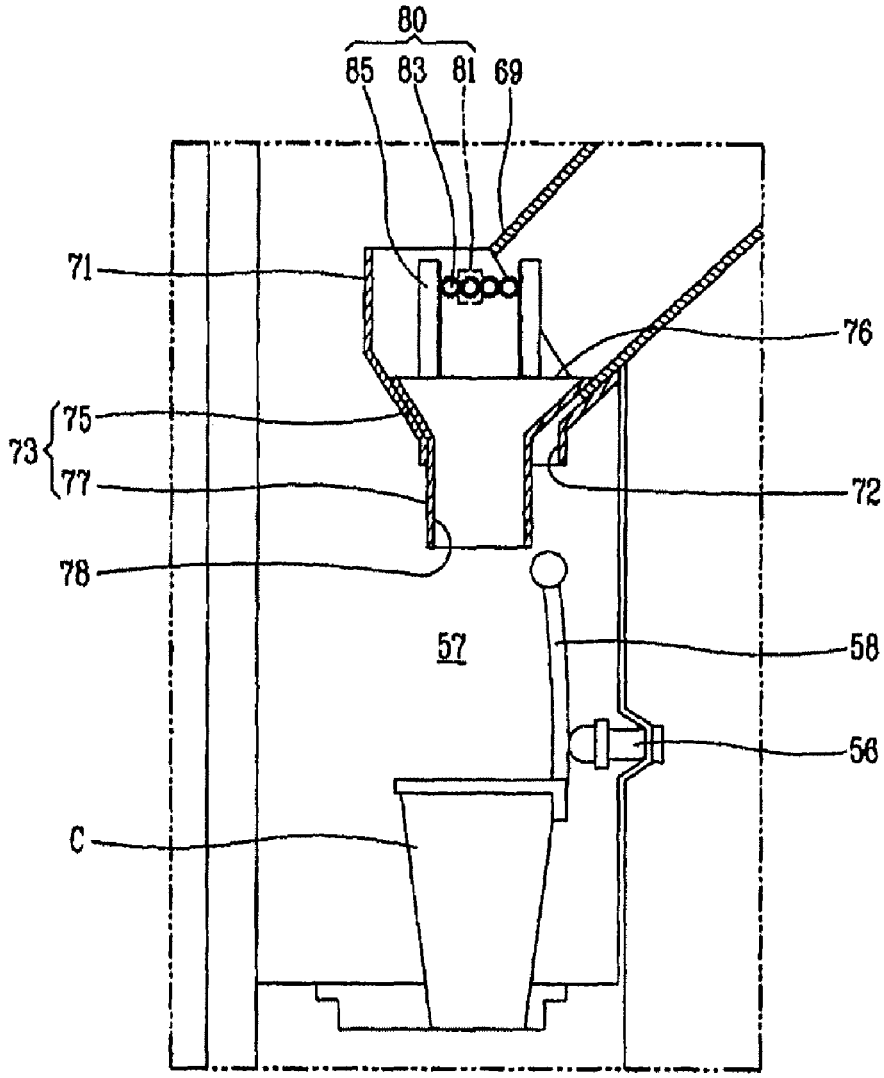
FIG. 6 is a section view showing that the moving guider shown in FIG. 5 is protruded from the fixing guider.
Figure 7:
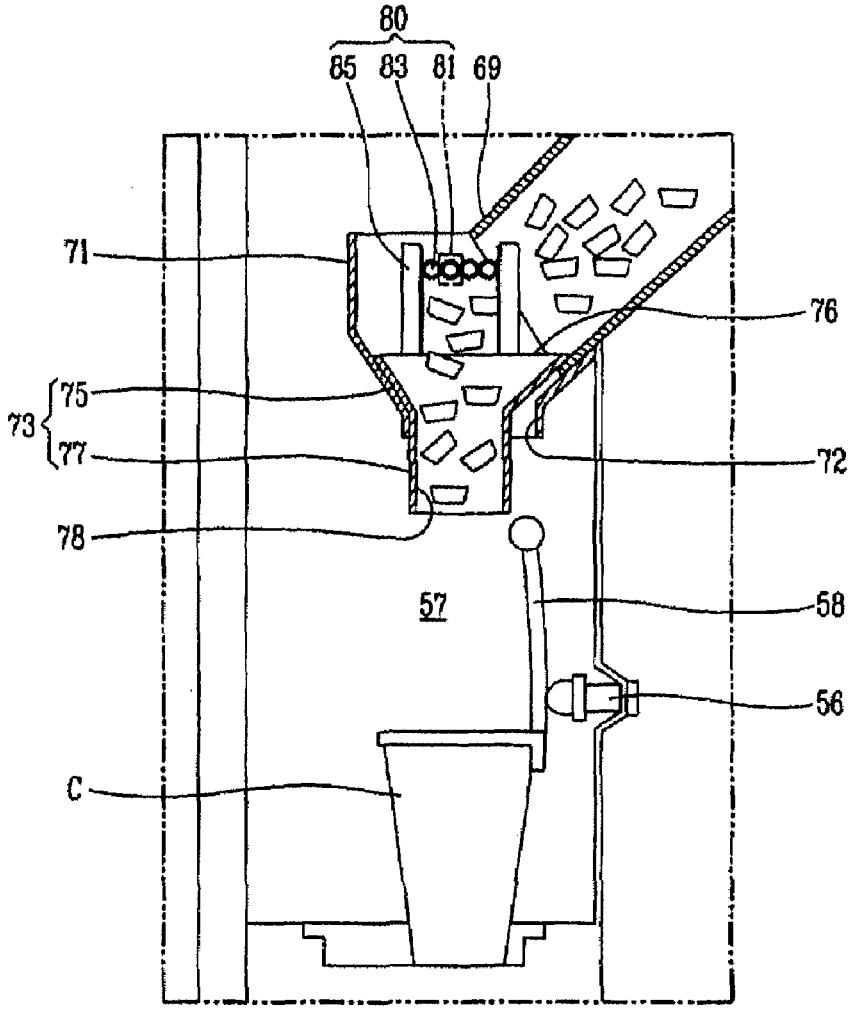
FIG. 7 is a section view showing that ice pieces are guided through the fixing guider and the moving guider shown in FIG. 6.

FIG. 4 is a schematic section view showing that a moving guider is located in a fixing guider in a refrigerator having an ice guiding apparatus of a dispenser in accordance with the fourth embodiment of the present invention, FIG. 5 is a section view showing that the operation lever shown in FIG. 4 is pressed, FIG. 6 is a section view showing that the moving guider shown in FIG. 5 is protruded from the fixing guider, and FIG. 7 is a section view showing that ice pieces are guided along the fixing guider and the moving guider shown in FIG. 6.

Referring to FIGS. 4 to 7, in this embodiment, a driving unit 80 is provided to move the moving guider 73 upwardly and downwardly with respect to the fixing guider 71.

The driving unit 80 may include a driving motor 81, a plurality of pinions 83 and one pair of racks 85.

The driving motor 81 provides the driving force for moving the moving guider 73. A bi-directional motor which can be driven two directions is used for the driving motor 81, for moving the moving guider 73 upwardly and downwardly.

The driving motor 81 rotates in a direction for moving the moving guider 73 downwardly by switching on the switch 56. This direction may be defined as a forward direction. And, the driving motor 81 rotates in a direction for moving the moving guider 73 upwardly by switching off the switch 56. This direction may be defined as a backward direction.

Meanwhile, the pinions 83 serve to transfer the driving force of the driving motor 81 to the racks 85. In the illustrated embodiment, four pinions 83 are provided and any one of them is connected to a driving shaft of the driving motor 81.

Also, the racks 85 are formed to be long in a vertical direction and have lower ends respectively fixed to the upper end of the moving guider 73. The racks 85 are gear-coupled to the pinions 83 so as to substantially move the moving guider 73 upwardly and downwardly by being linearly moved vertically by driving of the driving motor 81.

As aforementioned, as the driving unit 80 is provided, the moving guider 73 can be precisely moved upwardly and downwardly, accordingly the ice pieces can be smoothly guided in the ice guiding apparatus, and the moving guider 73 automatically moves upwardly and downwardly, accordingly it is capable of enhancing convenience when using the ice guiding apparatus.

Hereafter, an operation of the ice guiding apparatus in accordance with this embodiment will be explained.

First, as shown in FIG. 4, in case that it is not required to discharge ice pieces through the dispenser 57, the moving guider 73 is located in the fixing guider 71. That is, the guiding portion 77 of the moving guider 73 is not protruded outwardly through the fixing guide opening 72 of the fixing guider 71.

In this state, as shown in FIG. 5, when the user presses the manipulation lever 58 by using the ice container, the switch 56 is switched on. And, the pinions 83 are rotated by the moving motor 81 driving in the forward direction on the drawing by the switch 56 having been switched on so that the racks 85 are downwardly moved. Accordingly, the moving guider 73 downwardly moves. Thus, the guiding portion 77 is downwardly moved and then protruded to the outside of the fixing guider 71 through the fixing guide opening 72. As shown in FIG. 6, the moving guider 73 continues to move until the stopping portion 75 is stopped at the fixing guider 71.

And then, as shown in FIG. 7, after the guiding portion 77 is entirely protruded to the outside of the fixing guider 71 by moving of the moving guider 73, the transfer motor 66 of the ice maker 61 may be driven.

That is, in case that the dispenser 57 requires to provide ice pieces, the driving unit 80 moves the moving guider 73 before the ice pieces are supplied to the moving guider 73 through the ice duct 69. Accordingly, the ice pieces are supplied after the moving guider 73 is entirely moved down, thereby being capable of precisely guiding the ice pieces supplied thereto into the ice container.

Meanwhile, upon completing discharging of the ice pieces into the ice container, the user stops pressing the operation lever 58 by using the ice container. Then, the transfer motor 66 stops driving, thus the discharging of ice pieces is stopped. Also, the driving motor 81 is rotated in the backward direction, accordingly the moving guider 73 moves with reversing the abovementioned procedure. Thus, the moving guider 73 is located in the fixing guider 71.

That is, in case that the dispenser 57 stops requiring to provide the ice pieces, the driving unit 80 restores the moving guider 73 into its original position after the ice supply to the moving guider 73 through the ice duct 69 is stopped. Thus, the moving guider 73 remains in the lowered state before the supplying of the ice pieces is entirely stopped, thereby being capable of precisely guiding the ice pieces supplied thereto into the ice container.

Figure 8:
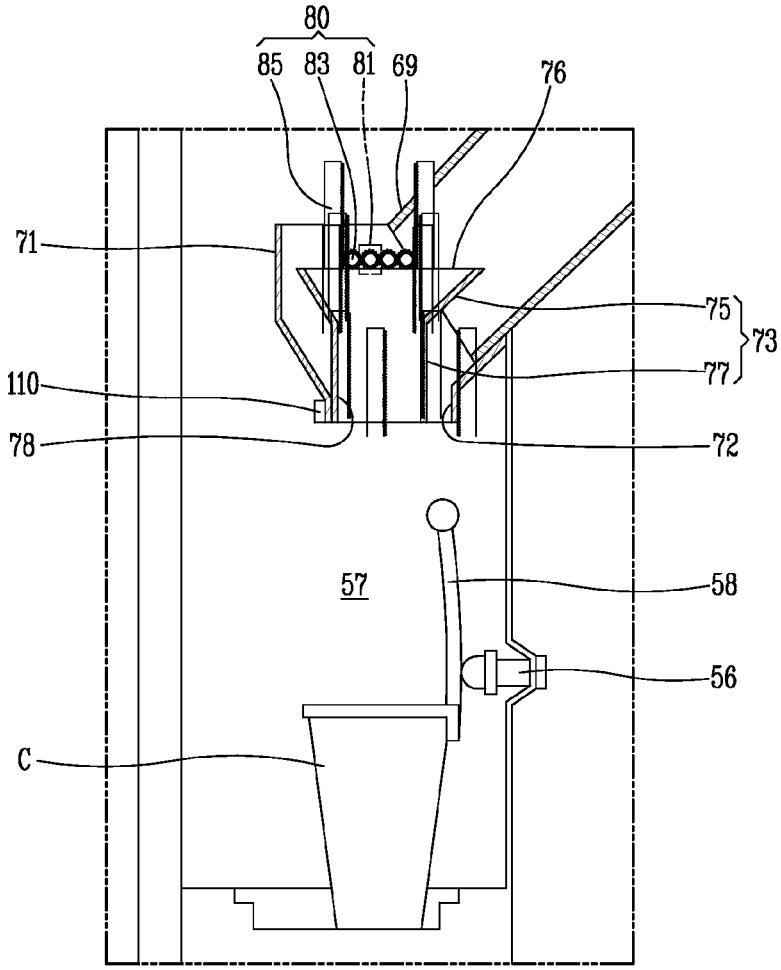
FIG. 8 is a schematic section view partially showing a refrigerator having an ice guiding apparatus of a dispenser in accordance with a fifth embodiment of the present invention.
Figure 9:
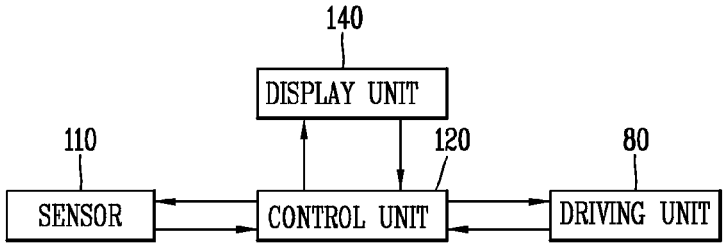
FIG. 9 is a block diagram showing elements configured to control a driving motor in the fifth embodiment of the present invention.

FIG. 8 is a schematic section view partially showing the refrigerator having the ice guiding apparatus of the dispenser in accordance with the fifth embodiment of the present invention, and FIG. 9 is a block diagram showing elements configured to control the driving motor in the fifth embodiment of the present invention.

Referring to FIGS. 8 and 9, in this embodiment, a sensor 110 is provided at the end of the fixing guider 71. The sensor 110 serves to sense the distance between the lower end of the fixing guider 71 and the cup C putted at the dispenser 57.

A value sensed by the sensor 110 is transferred to the control unit 120. The control unit 120 receiving the information transfers a command corresponding to the distance value. The driving motor 81 is driven according to the command transferred to a driving unit 80. A result value of the processing at the control unit 120 may be displayed on a display unit 140.

With such configuration, when the cup C is putted at the dispenser 57, the sensor 110 senses the cup C. Then, the sensed value is transferred to the control unit 120, and then the control unit 120 transfers a command for the driving motor 81 to be driven in the forward direction.

The driving motor 81 is driven in the forward direction according to the command transferred to the driving unit 80, accordingly the driving guider 73 may move downwardly.

Meanwhile, when supplying of the ice pieces with respect to the cup C is completed and the cup C is separated from the dispenser 57, the sensor 110 senses the separation of the cup C according to variation of the distance value. Then, the sensed value is transferred to the control unit 120 and the control unit 120 transfers a command for the driving motor 81 to be driven in the backward direction.

The driving motor 81 is driven in the backward direction according to the command transferred to the driving unit 80, and accordingly the moving guider 73 may move upwardly.

As such, the sensor 110 senses whether or not the cup C exists and then controls the operation of the moving guider 73, accordingly the moving guider 73 can be automatically driven, thereby being capable of enhancing the user's convenience.

Here, it is disclosed that the sensor 110 is installed at the fixing guider 71 as an exemplary description, but the sensor 110 may be installed at another portion of the moving guider 73 or the dispenser 57.

The refrigerator according to the present invention has the following advantages.

According to the ice guiding apparatus of the dispenser for the refrigerator in accordance with one aspect of the present invention, the moving guider upwardly and downwardly moves along the fixing guider, and thus the passage for guiding the ice pieces is expanded. Accordingly, the distance spaced between the upper end of the ice container putted at the dispenser and the lower end of the moving guider may be reduced, thereby being capable of precisely discharging the ice pieces into the ice container.

According to the ice guiding apparatus of the dispenser for the refrigerator in accordance with another aspect of the present invention, when requirement for supplying the ice pieces is stopped, the moving guider moves back into its original position, the fixing guider, thereby being capable of preventing the ice container from being interfered with the moving guider when the ice container is separated from the dispenser.

According to the ice guiding apparatus of the dispenser for the refrigerator in accordance with still another aspect of the present invention, as the elastic member is provided, the moving guider may be moved by the load of the ice pieces supplied through the ice duct and restored to its original position by the elastic force provided by the elastic member. Thus, it is not required to provide an additional external force for moving the moving guider upwardly and downwardly, thereby being capable of enhancing convenience when using the ice guiding apparatus.

According to the ice guiding apparatus of the dispenser for the refrigerator in accordance with yet still another aspect of the present invention, as the guide portion is provided, the ice pieces supplied through the ice duct can be smoothly moved into the moving guider by the guide portion, thereby being capable of smoothly moving the ice pieces in the ice guiding apparatus.

According to the ice guiding apparatus of the dispenser for the refrigerator in accordance with yet still another aspect of the present invention, the expansion portion is formed at the portion facing the guide portion of the ice duct, accordingly the passage through which the ice pieces supplied through the ice duct pass can be expanded, thereby being capable of smoothly moving the ice pieces in the ice guiding apparatus.

According to the ice guiding apparatus of the dispenser for the refrigerator in accordance with yet still another aspect of the present invention, as the driving unit is provided, the moving guider can be precisely moved upwardly and downwardly, accordingly the ice pieces can be smoothly guided in the ice guiding apparatus, and the moving guider can automatically move upwardly and downwardly, accordingly it is capable of enhancing convenience when using the ice guiding apparatus.

According to the ice guiding apparatus of the dispenser for the refrigerator in accordance with yet still another aspect of the present invention, when the dispenser requires providing the ice pieces, the moving guider is moved by the driving unit before the ice pieces are supplied to the moving guider through the ice duct. Accordingly, the ice pieces are supplied after the moving guider entirely moves down, thereby being capable of precisely guiding the supplied ice pieces into the ice container.

According to the ice guiding apparatus of the dispenser for the refrigerator in accordance with yet still another aspect of the present invention, when the dispenser stops requiring to provide the ice pieces, the moving guider is restored into its original position by the driving unit after the supplying of ice pieces to the moving guider through the ice duct is stopped. Accordingly, the moving guider remains in the lowered state before the supplying of ice pieces is entirely stopped, thereby being capable of precisely guiding the supplied ice pieces into the ice container.

According to the ice guiding apparatus of the dispenser for the refrigerator in accordance with yet still another aspect of the present invention, the sensor senses whether or not the cup is putted at the dispenser, and accordingly the operation of the moving guider is controlled. Accordingly, the moving guider can be automatically driven, thereby being capable of enhancing the user's convenience.

According to the ice guiding apparatus of the dispenser for the refrigerator in accordance with one embodiment of the present invention, it prevents interference between the ice discharge opening and the ice container putted at the dispenser, accordingly the ice pieces can be precisely guided into the ice container, thereby having a high industrial applicability.

Though the present invention is disclosed with respect to specific embodiments in the above description, it will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. An ice guiding apparatus of a dispenser for a refrigerator, the ice guiding apparatus comprising:

a fixing guider located at the dispenser, and connected to an ice duct that supplies ice pieces made by an ice maker toward the fixing guider;

a moving guider that guides the ice pieces that have passed through the ice duct by upwardly and downwardly moving along the fixing guider; and an elastic member that provides an elastic force so as to move the moving guider having been downwardly moved back into its original position.

2. The ice guiding apparatus of claim 1, wherein the moving guider moves along the fixing guider so that a passage for guiding the ice pieces is extended.

3. The ice guiding apparatus of claim 2, wherein an end portion of the moving guider is outwardly protruded from the fixing guider when the moving guider moves along the fixing guider.

4. The ice guiding apparatus of claim 1, wherein the moving guider comprises a stopping portion for restricting a range for moving the moving guider upwardly and downwardly by being stopped at the fixing guider, and a guiding portion for outwardly guiding the ice pieces supplied from the ice duct.

5. The ice guiding apparatus of claim 4, wherein the stopping portion and the guiding portion are communicated with each other so that the ice pieces supplied from the ice duct can pass therethrough.

6. The ice guiding apparatus of claim 5, wherein the stopping portion is formed in a shape having a sectional area decreased toward a lower side from an upper side thereof, wherein the fixing guider has an end portion formed in a shape corresponding to the stopping portion so that the stopping portion is stopped at the end portion of the fixing guider when the moving guider moves downwardly.

7. The ice guiding apparatus of claim 1, wherein the elastic member has one end connected to the fixing guider and the other end connected to the moving guider.

8. The ice guiding apparatus of claim 1, wherein the moving guider is moved by a load of the ice pieces supplied through the ice duct, and the elastic member provides the moved moving guider with the elastic force.

9. The ice guiding apparatus of claim 1 further comprising:

a guide portion for guiding the ice pieces supplied through the ice duct into an inlet of the moving guider.

10. The ice guiding apparatus of claim 9, wherein an ice-guiding surface of the guide portion which the ice pieces supplied through the ice duct pass through and the inlet of the moving guider are smoothly connected to each other.

11. The ice guiding apparatus of claim 9, wherein an expansion portion is formed at a portion facing the guide portion of the ice duct, for expanding a passage for passing the ice pieces supplied through the ice duct.

12. A dispenser for a refrigerator, the dispenser comprising:

an ice duct that guides ice pieces made by an ice maker; and an ice guiding apparatus, the ice guiding apparatus comprising:

a fixing guider connected to the ice duct that supplies the ice pieces made by the ice maker toward the fixing guider, a moving guider that guides the ice pieces that have passed through the ice duct by upwardly and downwardly moving along the fixing guider, and an elastic member that provides an elastic force so as to move the moving guider having been downwardly moved back into its original position.

13. The dispenser of claim 12, wherein the moving guider moves along the fixing guider so that a passage for guiding the ice pieces is extended.

14. The dispenser of claim 13, wherein an end portion of the moving guider is outwardly protruded from the fixing guider when the moving guider moves along the fixing guider.

15. The dispenser of claim 12, wherein the moving guider comprises a stopping portion for restricting a range for moving the moving guider upwardly and downwardly by being stopped at the fixing guider, and a guiding portion for outwardly guiding the ice pieces supplied from the ice duct.

16. The dispenser of claim 15, wherein the stopping portion and the guiding portion are communicated with each other so that the ice pieces supplied from the ice duct can pass therethrough.

17. The dispenser of claim 12, wherein the elastic member has one end connected to the fixing guider and the other end connected to the moving guider.

18. The dispenser of claim 12, wherein the moving guider is moved by a load of the ice pieces supplied through the ice duct, and the elastic member provides the moved moving guider with the elastic force.

19. A refrigerator comprising:

an ice maker configured to make ice pieces; and a dispenser configured to dispense the ice pieces made by the ice maker, the dispenser comprising:

an ice duct that guides the ice pieces made by the ice maker; and an ice guiding apparatus, the ice guiding apparatus comprising:

a fixing guider connected to the ice duct that supplies the ice pieces made by the ice maker toward the fixing guider, a moving guider that guides the ice pieces that have passed through the ice duct by upwardly and downwardly moving along the fixing guider, and an elastic member that provides an elastic force so as to move the moving guider having been downwardly moved back into its original position.

20. The refrigerator of claim 19, wherein the moving guider moves along the fixing guider so that a passage for guiding the ice pieces is extended.

21. The refrigerator of claim 20, wherein an end portion of the moving guider is outwardly protruded from the fixing guider when the moving guider moves along the fixing guider.

22. The refrigerator of claim 19, wherein the moving guider comprises a stopping portion for restricting a range for moving the moving guider upwardly and downwardly by being stopped at the fixing guider, and a guiding portion for outwardly guiding the ice pieces supplied from the ice duct.

23. The refrigerator of claim 22, wherein the stopping portion and the guiding portion are communicated with each other so that the ice pieces supplied from the ice duct can pass therethrough.

24. The refrigerator of claim 19, wherein the elastic member has one end connected to the fixing guider and the other end connected to the moving guider.

25. The refrigerator of claim 19, wherein the moving guider is moved by a load of the ice pieces supplied through the ice duct, and the elastic member provides the moved moving guider with the elastic force.

* * * * *